US011245204B1

(12) United States Patent
Lin et al.

(10) Patent No.: US 11,245,204 B1
(45) Date of Patent: Feb. 8, 2022

(54) ANTENNA MODULE

(71) Applicant: Wistron Corporation, New Taipei (TW)

(72) Inventors: Po-Tsang Lin, New Taipei (TW); Ying-Sheng Fang, New Taipei (TW); Cheng-Wei Chen, New Taipei (TW)

(73) Assignee: Wistron Corporation, New Taipei (TW)

( * ) Notice: Subject to any disclaimer, the term of this patent is extended or adjusted under 35 U.S.C. 154(b) by 8 days.

(21) Appl. No.: 17/013,819

(22) Filed: Sep. 7, 2020

(30) Foreign Application Priority Data

Aug. 7, 2020 (TW) ..... 109126837

(51) Int. Cl.
*H01Q 21/28* (2006.01)
*H01Q 5/35* (2015.01)
*H01Q 1/24* (2006.01)

(52) U.S. Cl.
CPC ..... *H01Q 21/28* (2013.01); *H01Q 1/243* (2013.01); *H01Q 5/35* (2015.01)

(58) Field of Classification Search
CPC ..... H01G 1/243; H01G 5/35
See application file for complete search history.

(56) References Cited

U.S. PATENT DOCUMENTS 6,448,932 B1 9/2002 Stoiljkovic et al.

OTHER PUBLICATIONS

"Office Action of Taiwan Counterpart Application", dated Apr. 8, 2021, p. 1-p. 7.

*Primary Examiner* — Graham P Smith
(74) *Attorney, Agent, or Firm* — JCIPRNET

(57) ABSTRACT

An antenna module includes first and second antennas. The first antenna includes first, second and third radiators. A first end of the first antenna is a first feed-in end. The second and third radiators are connected to a second end of the first radiator. The second radiator has a first ground. The second antenna includes fourth, fifth and sixth radiators. The fifth radiator is connected to a second feed-in end of the fourth radiator. A second ground is located at an intersection between the fifth and sixth radiators. The antenna module covers first, second and third frequency bands.

21 Claims, 12 Drawing Sheets

ANTENNA MODULE

CROSS-REFERENCE TO RELATED APPLICATION

This application claims the priority benefit of Taiwan application no. 109126837, filed on Aug. 7, 2020. The entirety of the above-mentioned patent application is hereby incorporated by reference herein and made a part of this specification.

TECHNICAL FIELD

The invention relates to an antenna module, and more particularly, relates to a multi-band antenna module.

BACKGROUND

With the advancement of science and technology, the demand for multi-band antennas has gradually increased. How to enable the antenna to couple multiple frequency bands is the goal of the research in this field.

SUMMARY

The invention provides an antenna module, which can meet the requirements of multi-band.

An antenna module of the invention is adapted to be disposed on a frame, and the antenna module includes a first antenna and a second antenna. The first antenna includes a first radiator, a second radiator and a third radiator. The first radiator has a first end and a second end opposite to each other. The first end is a first feed-in end. The second radiator and the third radiator are connected to the second end of the first radiator. The second radiator has a first ground. The second antenna includes a fourth radiator, a fifth radiator and a sixth radiator. The fourth radiator has a second feed-in end. The fifth radiator is connected to the second feed-in end. The sixth radiator is connected to the fifth radiator. A second ground is located at an intersection between the fifth radiator and the sixth radiator. The antenna module covers a first frequency band, a second frequency bands and a third frequency band.

An electronic device of the invention includes a bracket and the antenna module described above. The antenna module is disposed on a plurality of surfaces of the frame.

In an embodiment of the invention, a width of the third radiator is 0.4 times to 0.6 times a width of the first radiator.

In an embodiment of the invention, the surfaces of the frame include a top surface, a first lateral surface, a bottom surface, and a first inclined surface located below the top surface and connected to the bottom surface, which are connected to each other. The first radiator is bended into multiple sections and has a conductive hole to be adapted to pass through the frame from the bottom surface along the first inclined surface to the top surface and extend to the first lateral surface. The first feed-in end is located on the bottom surface. The second radiator is disposed on the bottom surface. The third radiator is disposed on the first lateral surface.

In an embodiment of the invention, the first antenna further includes a first extension, adapted to be disposed on the top surface and connected to a portion of the first radiator located on the top surface.

In an embodiment of the invention, the surfaces of the frame include a top surface, a second inclined surface, a second lateral surface, a bottom surface, a third inclined surface, and an inner surface, which are connected to each other. The fourth radiator is bent into multiple sections to be adapted to extend from the bottom surface, the second lateral surface, and the top surface to the second inclined surface. The fifth radiator is adapted to extend from the bottom surface and the third inclined surface to the inner surface. The sixth radiator is adapted to be at least disposed on the bottom surface.

In an embodiment of the invention, a width of a portion of the fourth radiator located on the top surface is greater than a width of a remaining portion of the fourth radiator.

In an embodiment of the invention, the second antenna further includes a second extension extending from the second feed-in end and parallel to a portion of the fifth radiator. The second extension is adapted to be disposed on the third inclined surface and the inner surface. The second extension includes a second conductive hole to be adapted to pass through the frame.

In an embodiment of the invention, the frame includes a fourth inclined surface located between the top surface and the inner surface. The second antenna further includes a third extension. The third extension includes a third conductive hole to be adapted to pass through the frame to be connected to the fifth radiator. The third extension is adapted to be disposed on the fourth inclined surface and located beside the fourth radiator.

In an embodiment of the invention, a width of the third extension is less than a width of the fifth radiator.

In an embodiment of the invention, the first frequency band is commonly coupled by the first radiator and the second radiator. The second frequency band is commonly coupled by the second radiator and the third radiator. The third frequency band is coupled by the second radiator. The second frequency band is coupled by the fifth radiator. The third frequency band is commonly coupled by a part of the fifth radiator and the sixth radiator.

In an embodiment of the invention, the first frequency band is between 2400 MHz and 2500 MHz. The second frequency band is between 5150 MHz and 5850 MHz. The third frequency band is between 6125 MHz and 7125 MHz.

In an embodiment of the invention, a fourth frequency band is coupled by the fourth radiator. The fourth frequency band is between 1500 MHz and 1650 MHz.

Based on the above, the first antenna of the antenna module of the invention includes the first radiator, the second radiator and the third radiator. The first end of the first antenna is the first feed-in end. The second radiator and the third radiator are connected to the second end of the first radiator. The second radiator has the first ground. The second antenna of the antenna module includes the fourth radiator, the fifth radiator and the sixth radiator. The fifth radiator is connected to the second feed-in end of the fourth radiator. The sixth radiator is connected to the fifth radiator. The second ground is located at the intersection between the fifth radiator and the sixth radiator. Through the above configuration, the antenna module of the invention can meet the requirements of multiple frequency bands.

DETAILED DESCRIPTION

The main technical improvement of the new generation of wireless local area network technology WIFI-6 802.11ax is divided into two stages. The first stage is to use the existing frequency band range of 2.4G and 5G frequency bands to increase the signal processing technology to increase the overall transmission rate. The second stage is to increase the bandwidth of the actual spectrum used. The original 5G frequency band (5150-5850 MHz) is extended to the 6G frequency band (5925 MHz to 7125 MHz) to increase the usable bandwidth range, which is the so-called WIFI 6E.

At present, the antenna design of products on the market only covers the ranges of 2.4 frequency band and 5G frequency band. In order to meet the bandwidth requirements of WIFI 6E, it is necessary to extend the bandwidth range of the 5G high frequency band to the 6G frequency band by expanding from the original 1 GHz to 2 GHz. In this way, it is necessary to double the bandwidth range, which greatly increases the difficulty of antenna design. The following will introduce an antenna module 100 that can meet the bandwidth requirements of WIFI 6E and an electronic device 10 having the antenna module 100.

Figure 1:
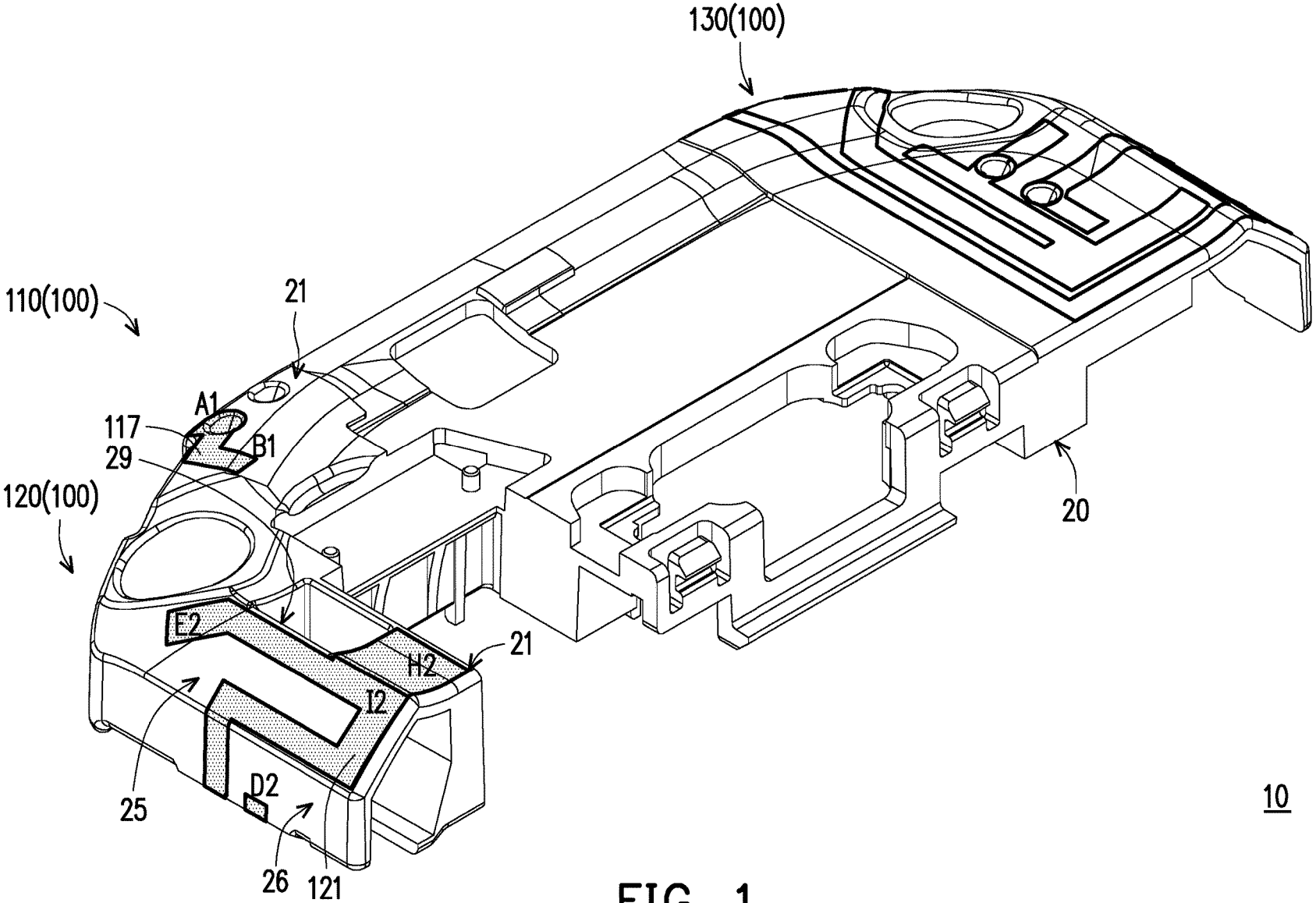
FIG. 1 is a 3D schematic diagram of an electronic device according to an embodiment of the invention.
Figure 2:
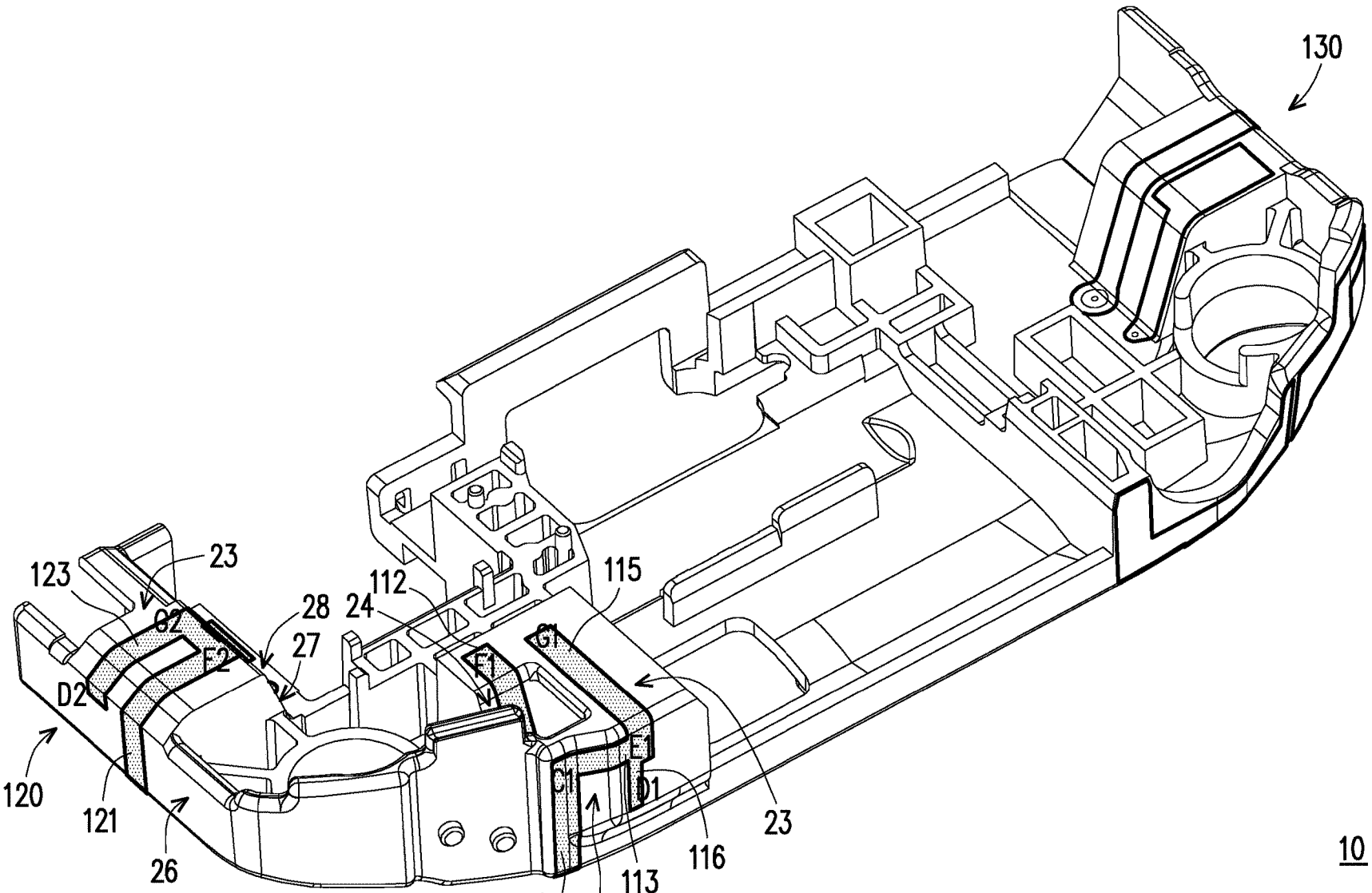
FIG. 2 is a 3D view of the electronic device of FIG. 1 from another perspective.
Figure 3:
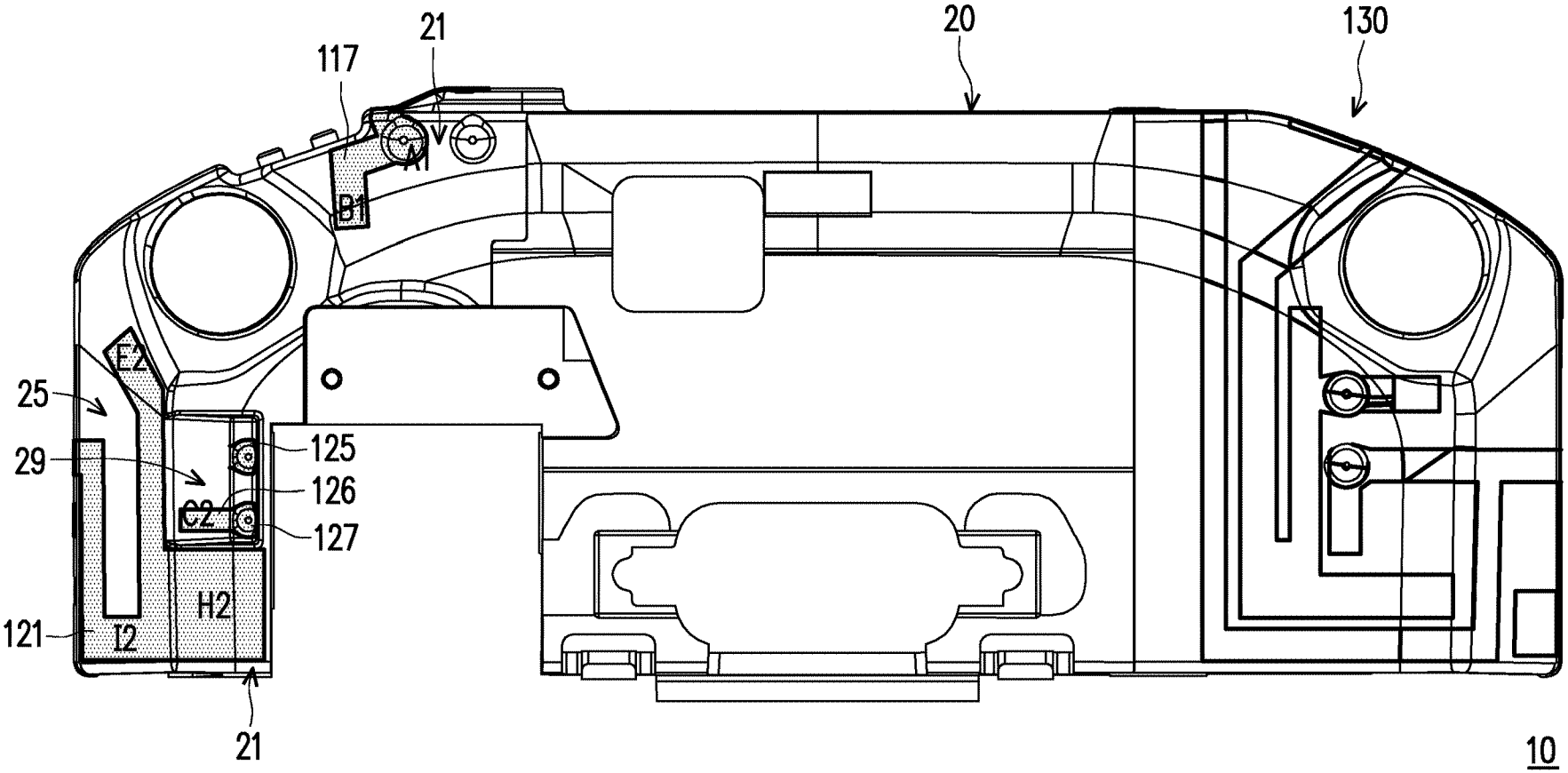
FIG. 3 is a top view of the electronic device of FIG. 1.
Figure 4:
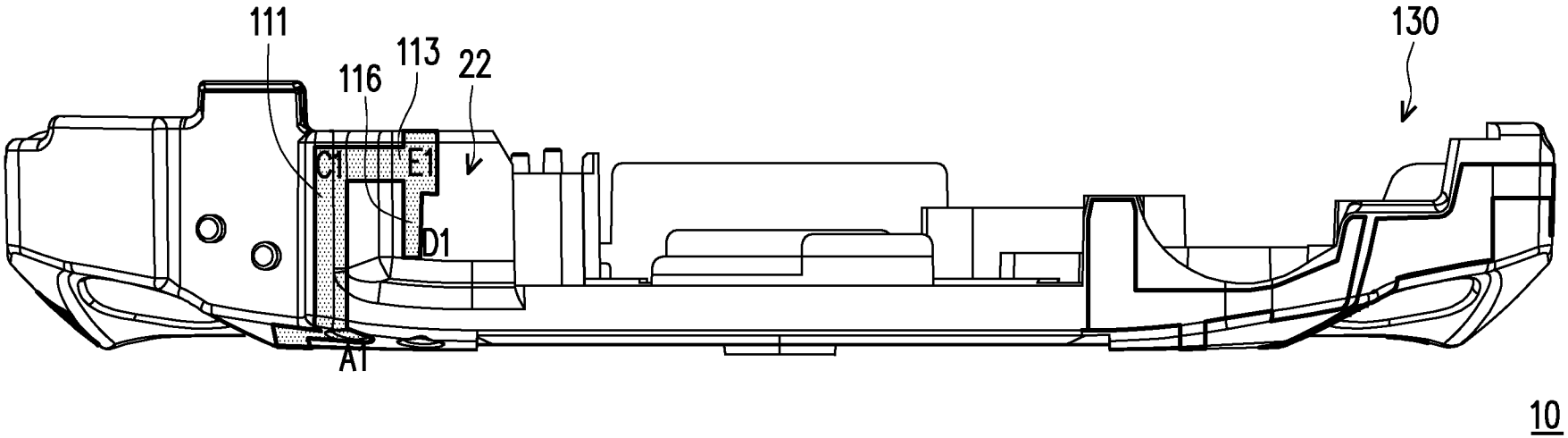
FIG. 4 is a side view of the electronic device of FIG. 1.
Figure 5:
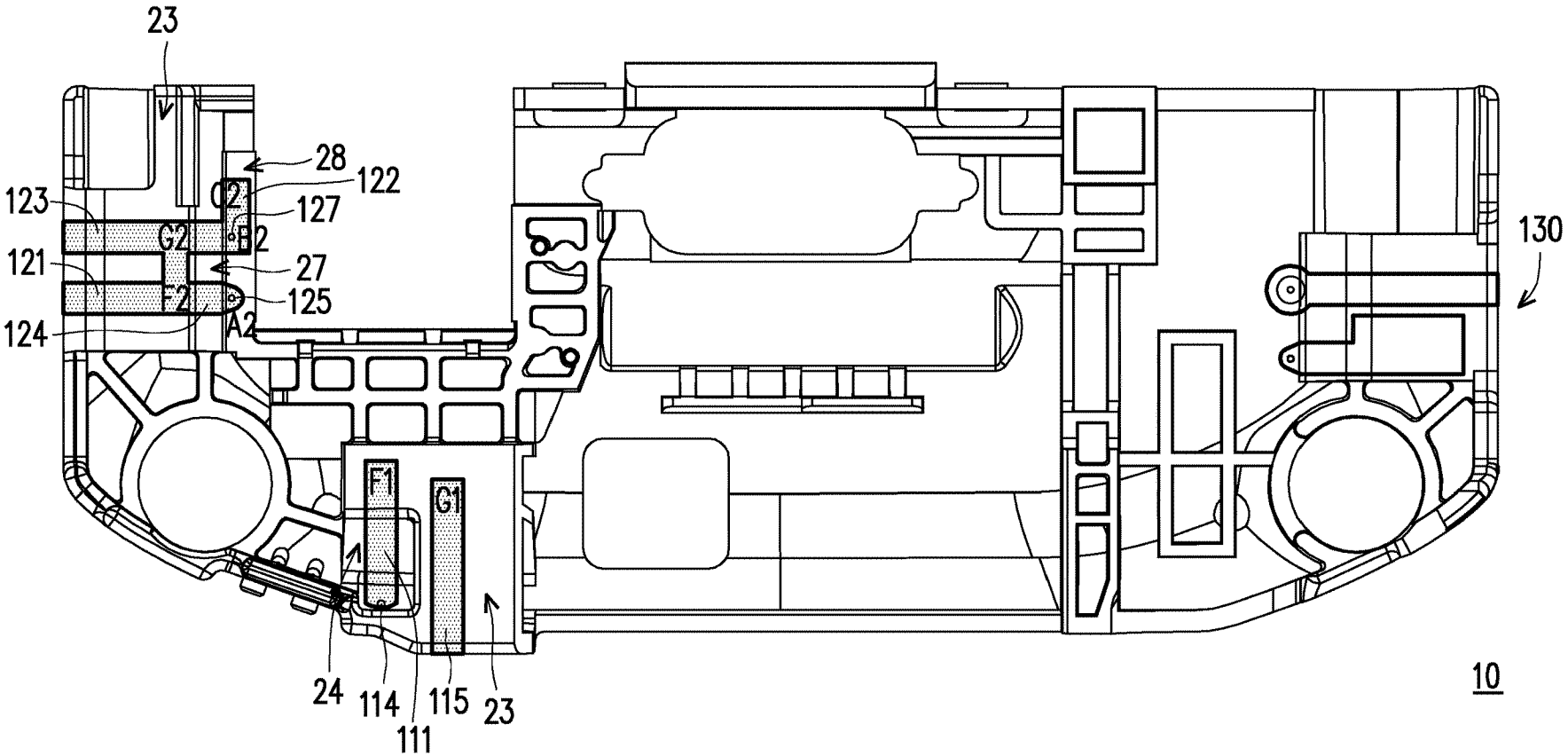
FIG. 5 is a bottom view of the electronic device of FIG. 1.
Figure 6:
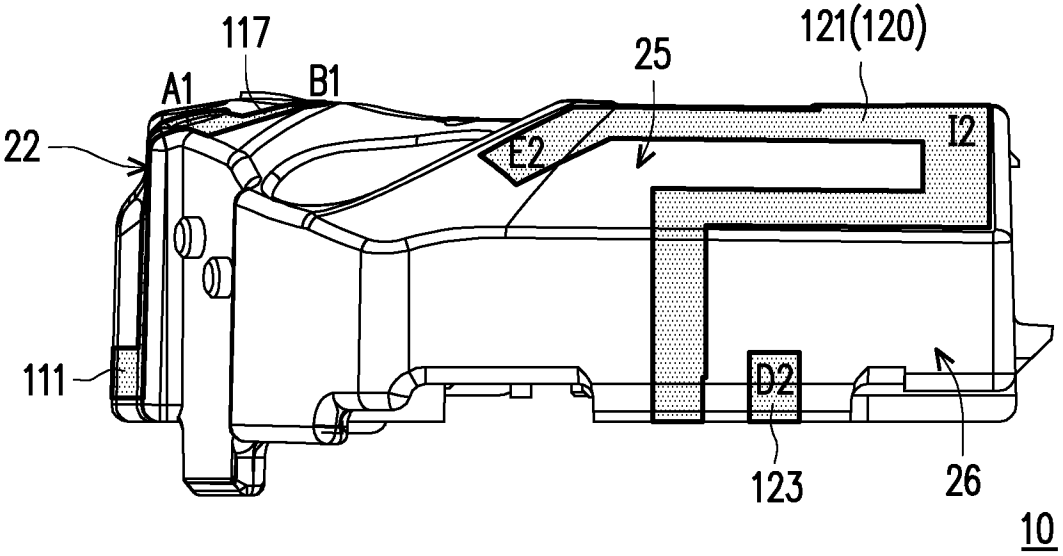
FIG. 6 is another side view of the electronic device of FIG. 1.

FIG. 1 is a 3D schematic diagram of an electronic device according to an embodiment of the invention. FIG. 2 is a 3D view of the electronic device of FIG. 1 from another perspective. FIG. 3 is a top view of the electronic device of FIG. 1. FIG. 4 is a side view of the electronic device of FIG. 1. FIG. 5 is a bottom view of the electronic device of FIG. 1. FIG. 6 is another side view of the electronic device of FIG. 1. It should be noted that in FIG. 1 to FIG. 6, in order to clearly show the antenna module, a housing and other structures of the electronic device are hidden, and only the antenna module and a frame are mainly shown.

Referring to FIG. 1 to FIG. 6, the electronic device 10 of this embodiment may be, for example, a mobile phone or a tablet computer. Specifically, for example, the electronic device 10 may be a mobile phone used in industry or medical use, which is attached with a scanner (not shown), but the type is not limited thereto.

The electronic device 10 at least includes a frame 20 and an antenna module 100. The antenna module 100 is disposed on the frame 20. The frame 20 can be used to carry the antenna module 100 and other components in the electronic device 10. Naturally, in an embodiment, the frame 20 may also be a frame specially used to carry the antenna module 100. Alternatively, in an embodiment, the frame 20 may be a part of the housing and have additional functions.

In this embodiment, as limited by a size, an internal space, and a configuration of surrounding components of the electronic device 10, a shape of the frame 20 is irregular. The antenna module 100 is a three-dimensional structure and can be disposed on a plurality of surfaces of the frame 20 according to the shape of the frame 20.

In this embodiment, the antenna module 100 includes a first antenna 110, a second antenna 120, and a third antenna 130. The first antenna 110 is mainly used to couple the frequency bands of 2.4G (2400 MHz to 2500 MHz), 5G (5150 MHz to 5850 MHz) and 6G (6125 MHz to 7125 MHz). The second antenna 120 is mainly used to couple the frequency bands of GPS (1500 MHz to 1650 MHz), 5G (5150 MHz to 5850 MHz) and 6G (6125 MHz to 7125 MHz). The third antenna 130 is mainly used to couple the frequency bands of 700 MHz to 960 MHz, 1700 MHz to 2200 MHz, and 2400 MHz to 2500 MHz. The following will describe the first antenna 110 and the second antenna 120 that can couple the 6G frequency band.

Figure 7A:
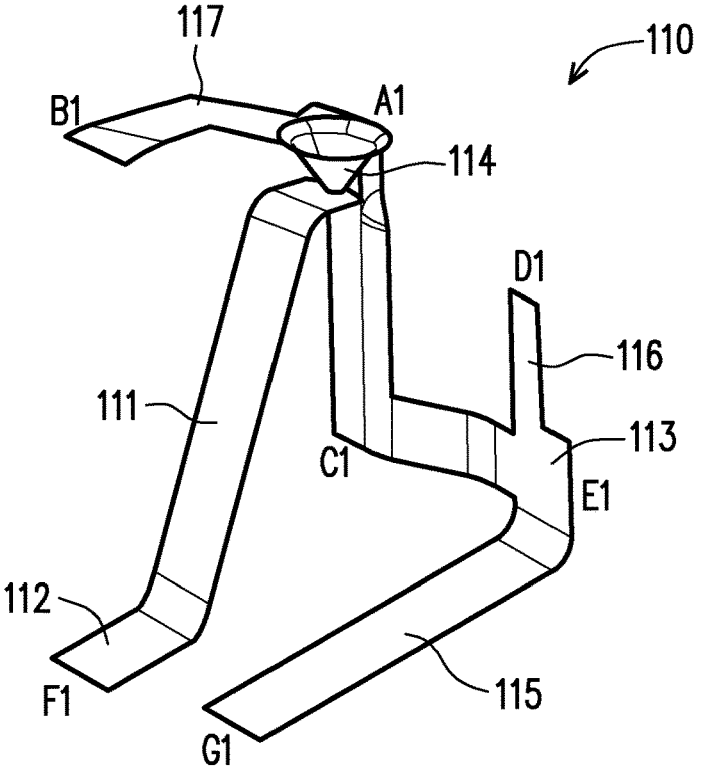
FIG. 7A to FIG. 7C are schematic diagrams of a first antenna of the electronic device in FIG. 1 from various perspectives.
Figure 7B:
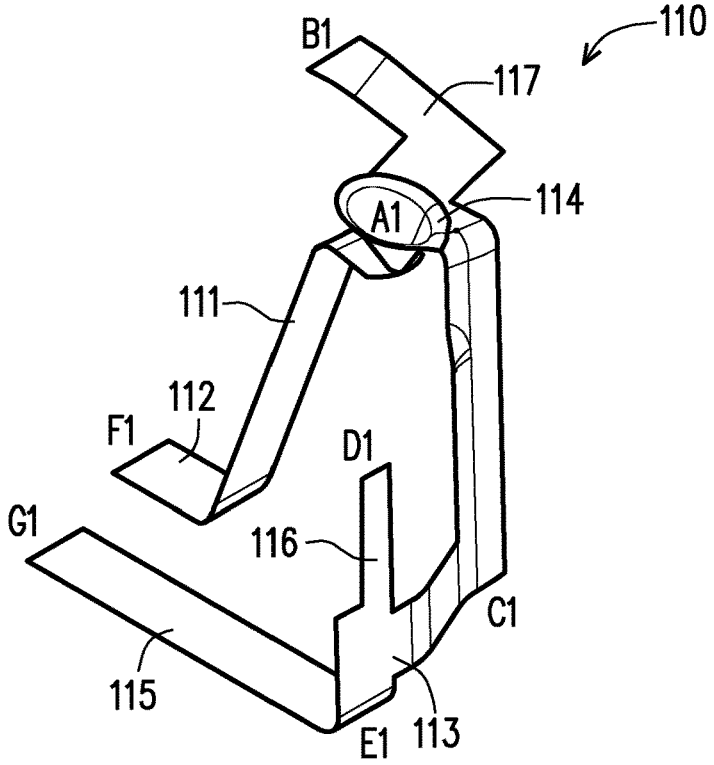
Figure 7C:
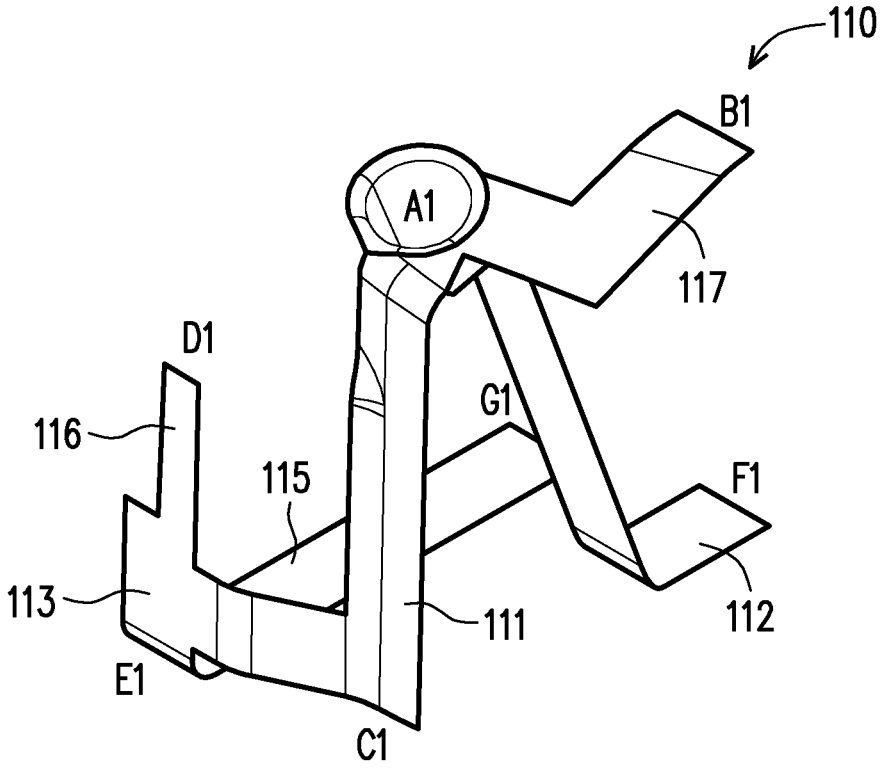

FIG. 7A to FIG. 7C are schematic diagrams of a first antenna of the electronic device in FIG. 1 from various perspectives. Referring to FIG. 7A to FIG. 7C, the first antenna 110 includes a first radiator 111, a second radiator 115 and a third radiator 116. In this embodiment, the first radiator 111 is a portion covered by a first feed-in end F1, positions A1, C1, and E1. The second radiator 115 is a portion covered by the position E1 to a first ground G1, and the third radiator 116 is a portion covered by the positions E1 and D1.

The first radiator 111 has a first end 112 and a second end 113 opposite to each other. The first end 112 is the first feed-in end F1. The second radiator 115 and the third radiator 116 are connected to the second end 113 of the first radiator 111. The second radiator 115 has the first ground G1. In addition, the first antenna 110 further includes a first extension 117 (the positions A1 and B1) that is the same height as the position A1.

In this embodiment, a first frequency band is commonly coupled by the first radiator 111 (the first feed-in end F1 and the positions A1, C1 and E1) and the second radiator 115 (the position E1 to the first ground G1). The first frequency band is, for example, between 2400 MHz and 2500 MHz. A length of the first radiator 111 (the first feed-in end F1 and the positions A1, C1 and E1) and the second radiator 115 (the position E1 to the first grounding G1) is approximately 32 mm, which is 0.23 times the wavelength of 2.4 GHz.

A second frequency band is commonly coupled by the second radiator 115 (the position E1 to the first ground G1) and the third radiator 116 (the positions E1 and D1). The second frequency band is, for example, between 5150 MHz and 5850 MHz. A length of the second radiator 115 (the position E1 to the first feed-in end F1) and the third radiator 116 (the positions E1 and D1) is approximately 12.5 mm, which is 0.23 times the wavelength of 5.5 GHz.

A third frequency band is coupled by the second radiator 115 (the position E1 to the first ground G1). The third frequency band is, for example, between 6125 MHz and 7125 MHz. A length of the second radiator 115 (the position E1 to the first feed-in end F1) is approximately 10 mm, which is 0.216 times the wavelength of 6.5 GHz. Naturally, the first frequency band, the second frequency band, and the third frequency band are not limited by the above.

In addition, in this embodiment, a width of the third radiator 116 (the positions E1 and D1) is less than a width of the first radiator 111 (the first feed-in end F1 and the positions A1, C1 and E1). Comparing the width of the third radiator 116 at the position D1 with the width of the first radiator 111 at the positions C1 and E1, it can be known that the width of the third radiator 116 is, for example, 0.4 times to 0.6 times the width of the first radiator 111. This design can adjust the impedance matching to resonate the 6G frequency band.

Figure 8A:
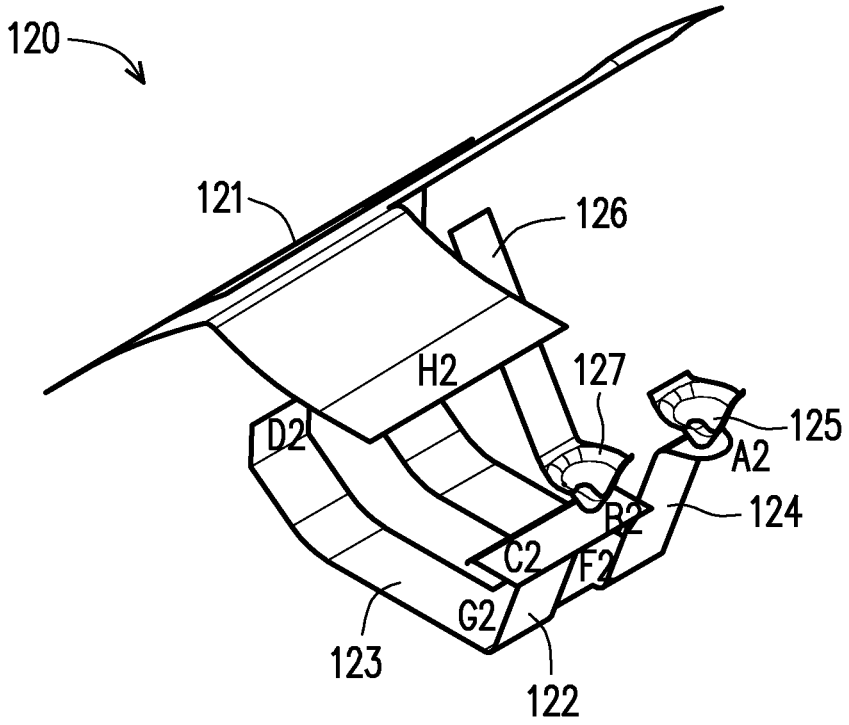
FIG. 8A to FIG. 8C are schematic diagrams of a second antenna of the electronic device in FIG. 1 from various perspectives.
Figure 8B:
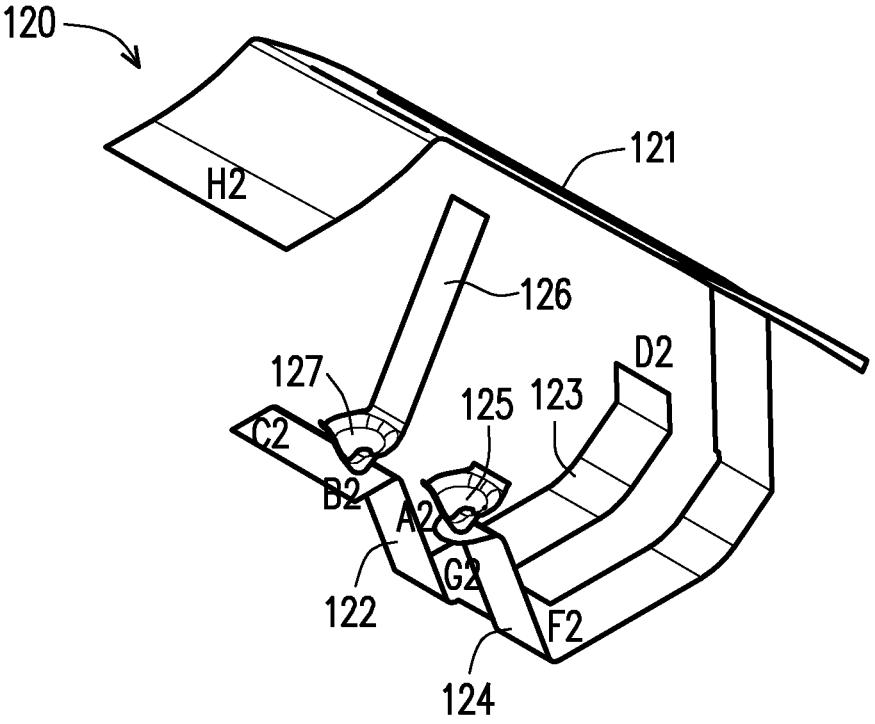
Figure 8C:
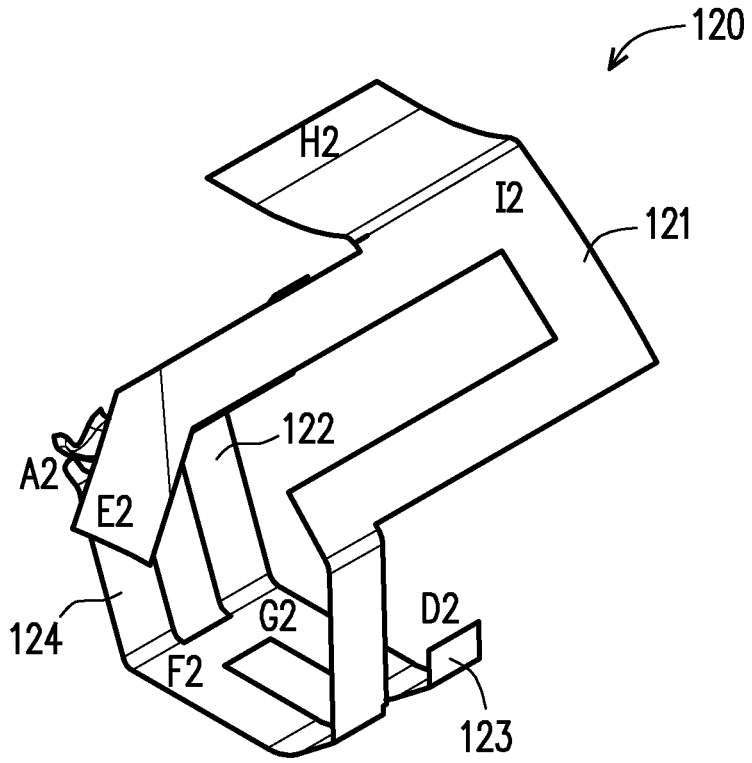

FIG. 8A to FIG. 8C are schematic diagrams of a second antenna of the electronic device in FIG. 1 from various perspectives. It should be noted that the viewing angles of FIGS. 8A to 8C are the same as the viewing angles of FIGS. 7A to 7C.

Referring to FIG. 8A to FIG. 8C, the second antenna 120 includes a fourth radiator 121, a fifth radiator 122 and a sixth radiator 123. In this embodiment, as shown in FIG. 8C, the fourth radiator 121 is a portion covered by a second feed-in end F2, positions I2, H2, and E2. As shown in FIG. 8B, the fifth radiator 122 is a portion covered by the second feed-in end F2, a second ground G2, and positions B2 and C2. As shown in FIG. 8A, the sixth radiator 123 is a portion covered by the second ground G2 and a position D2.

The fourth radiator 121 has the second feed-in end F2. The fifth radiator 122 (the second feed-in end F2, the second ground G2 and the positions B2 and C2) is connected to the second feed-in end F2. The sixth radiator 123 (the second ground G2 and the position D2) is connected to the fifth radiator 122. The second ground G2 is located at an intersection between the fifth radiator 122 and the sixth radiator 123.

Further, as shown in FIG. 8B, the second antenna 120 further includes a second extension 124 (the second feed-in end F2, a position A2 and a second conductive hole 125) extending from the second feed-in end F2 and parallel to a portion of the fifth radiator 122. In addition, the second antenna 120 further includes a third extension 126. The third extension 126 is located beside a portion of the fourth radiator 121 at the position H2, and can be coupled with the portion of the fourth radiator 121 at the position H2. The third extension 126 is connected to the second ground G2 through the position B2 to be grounded.

A fourth frequency band is coupled by the fourth radiator 121 (the second feed-in end F2 and the positions I2, H2 and E2). In this embodiment, the fourth frequency band is between 1500 MHz and 1650 MHz. A length of the fourth radiator 121 (the second feed-in end F2 and the positions I2, H2 and E2) is approximately 47.8 mm, which is 0.25 times the wavelength of 1.575 GHz.

The second frequency band is coupled by the fifth radiator 122 (the second feed-in end F2, the second ground G2 and the positions B2 and C2). The second frequency band is, for example, between 5150 MHz and 5850 MHz. A length of the fifth radiator 122 (the second feed-in end F2, the second ground G2 and the positions B2 and C2) is approximately 11.9 mm, which is 0.218 times the wavelength of 5.5 GHz.

The third frequency band is commonly coupled by a part of the fifth radiator 122 (the second feed-in end F2 and the second ground G2) and the sixth radiator 123 (the second ground G2 and the position D2). The third frequency band is, for example, between 6125 MHz and 7125 MHz. A length of the part of the fifth radiator 122 (the second feed-in end F2 and the second ground G2) and the sixth radiator 123 (the second ground G2 and the position D2) is approximately 11.6 mm, which is 0.25 times the wavelength of 6.5 GHz.

The position of the first antenna 110 on the frame 20 is first introduced below.

Referring back to FIG. 1, FIG. 2 and FIG. 7A, in this embodiment, the frame 20 includes a top surface 21 (FIG. 1), a first lateral surface 22 (FIG. 2), a bottom surface 23 (FIG. 2), and a first inclined surface 24 (FIG. 2) located below the top surface 21 and connected to the bottom surface 23, which are connected to each other.

The first radiator 111 (the first feed-in end F1 and the positions A1, C1 and E1) is bended into multiple sections and has a first conductive hole 114. As shown in FIG. 2, the first feed-in end F1 is located on the bottom surface 23. The first radiator 111 (the first feed-in end F1 and the positions A1, C1 and E1) is adapted to pass through the frame 20 via the first conductive hole 114 (FIG. 7A) from the bottom surface 23 (the first feed-in end F1) along the first inclined surface 24 to the top surface 21 (the position A1) shown in FIG. 1 and then extend from the top surface 21 (the position A1) to the first lateral surface 22 (the positions C1 and E1).

As shown in FIG. 2, the second radiator 115 (the position E1 to the first ground G1) is disposed on the bottom surface 23, and the third radiator 116 (the positions E1 and D1) is disposed on the first lateral surface 22. Further, as shown in FIG. 1, the first extension 117 (the positions A1 and B1) of the first antenna 110 is disposed on the top surface 21 and connected to a portion of the first radiator 111 located on the top surface 21 (the position A1).

That is, in this embodiment, the first antenna 110 crosses over the top surface 21 (FIG. 1), the first lateral surface 22 (FIG. 2), the bottom surface 23 (FIG. 2) and the first inclined surface 24 (FIG. 2) of the frame 20.

The position of the second antenna 120 on the frame 20 is introduced below.

Referring back to FIG. 1, FIG. 2, FIG. 5 and FIG. 8A to FIG. 8C, the frame 20 includes a second inclined surface 25 (FIG. 1), a second lateral surface 26 (FIG. 1), the bottom surface 23 (FIG. 2), a third inclined surface 27 (FIG. 5) and an inner surface 28 (FIG. 5).

The fourth radiator 121 (the second feed-in end F2 and the positions I2, H2 and E2) of the second antenna 120 is bent into multiple sections. As shown in FIG. 2, the second feed-in end F2 is located on the bottom surface 23. The fourth radiator 121 extends, from the bottom surface 23 (the second feed-in end F2) along the second lateral surface 26 (the position I2) of FIG. 1, the top surface 21 (the position H2) and the second lateral surface 26, to the second inclined surface 25 (the position E2). Further, in view of FIG. 1, a width of a portion of the fourth radiator 121 located on the top surface 21 (the position H2) is greater than a width of a remaining portion of the fourth radiator 121.

As shown in FIG. 5, the fifth radiator 122 (the second feed-in end F2, the second ground G2 and the positions B2 and C2) extends from the bottom surface 23 (the second feed-in end F2 and the second ground G2) and the second third inclined surface 27 (the position B2) to the inner surface 28 (the position C2).

As shown in FIG. 2, the sixth radiator 123 (the second ground G2 and the position D2) is at least disposed on the bottom surface 23. Specifically, the sixth radiator 123 extends from the bottom surface 23 (the second feed-in end F2 and the second ground G2) to the second lateral surface 26 (the position D2).

Referring to FIG. 2 and FIG. 5 together, the second extension 124 (the second feed-in end F2, the position A2 and the second conductive hole 125) is disposed on the third inclined surface 27 and the inner surface 28, and the second extension 124 includes the second conductive hole 125 and is adapted to pass through the frame 20.

In addition, referring to FIG. 1 and FIG. 3 together, the frame 20 includes a fourth inclined surface 29 located between the top surface 21 and the inner surface 28. As shown in FIG. 3, the third extension 126 is disposed on the fourth inclined surface 29. As shown in FIG. 8A, the third extension 126 includes a third conductive hole 127 to pass through the frame 20 to be connected to the fifth radiator 122. In this embodiment, a width of the third extension 126 is less than a width of the fifth radiator 122.

That is, in this embodiment, the second antenna 120 crosses over the top surface 21 (FIG. 1), the second inclined surface 25 (FIG. 1), the second lateral surface 26 (FIG. 1), the bottom surface 23 (FIG. 2), the third inclined surface 27 (FIG. 2) and the inner surface 28 (FIG. 2) of the frame 20.

It can be seen from the above configuration that, in response to the irregular shape of the frame 20, the antenna module 100 can be disposed on the frame 20 through multiple bends, conductive holes, etc. Accordingly, multiple frequency bands may be coupled in a limited space. In particular, the high frequency band of 6.5 GHz can be coupled to effectively expand the operating frequency band.

Figure 9:
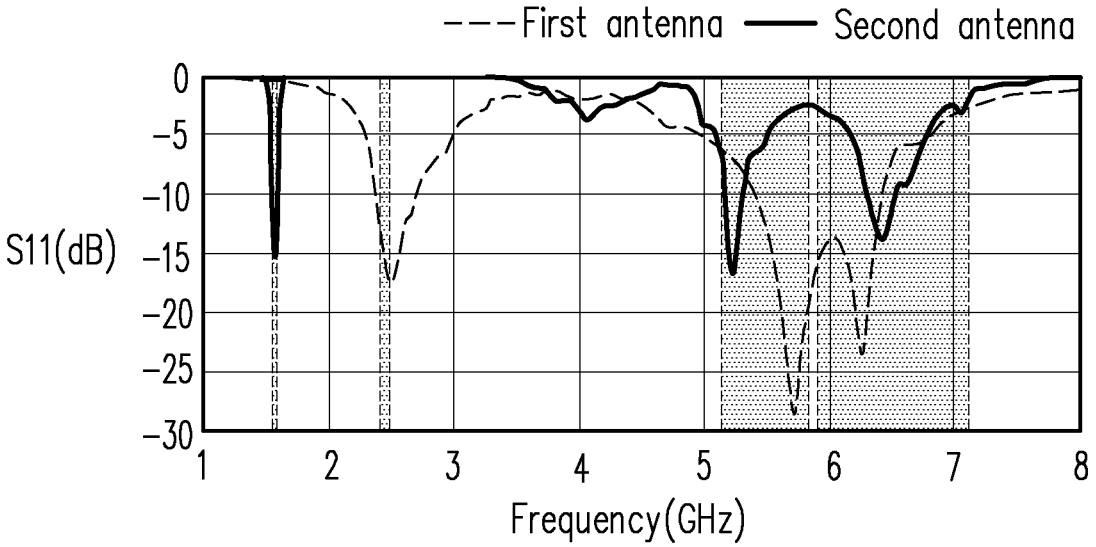
FIG. 9 is a S11 versus frequency graph for the first antenna and the second antenna of the antenna module of FIG. 1.

FIG. 9 is a S11 versus frequency graph for the first antenna and the second antenna of the antenna module of FIG. 1. Referring to FIG. 9, the first antenna 110 of the antenna module 100 of this embodiment can provide good performance with S11 lower than −6 dB in all of the first frequency band (2400 MHz to 2500 MHz), the second frequency band (5150 MHz to 5850 MHz) and the third frequency band (6125 MHz to 7125 MHz). Similarly, the second antenna 120 can provide good performance with S11 lower than −6 dB in all of the fourth frequency band (1500 MHz to 1650 MHz), the second frequency band (5150 MHz to 5850 MHz) and the third frequency band (6125 MHz to 7125 MHz).

Figure 10:
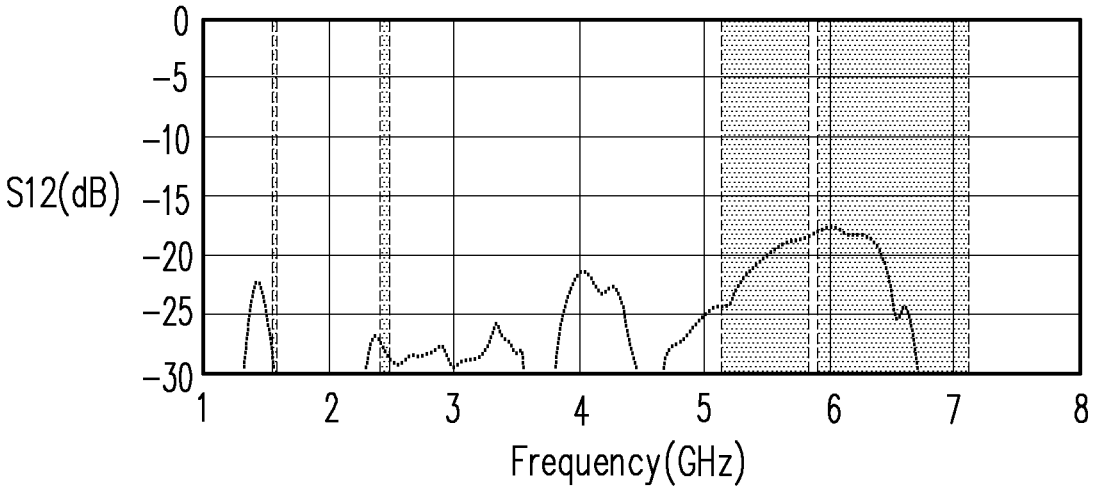
FIG. 10 is a S12 versus frequency graph for the first antenna and the second antenna of the antenna module of FIG. 1.

FIG. 10 is a S12 versus frequency graph for the first antenna and the second antenna of the antenna module of FIG. 1. Referring to FIG. 10, the first antenna 110 and the second antenna 120 of the antenna module 100 of this embodiment can provide good performance with S12 (isolation) lower than −15 dB in all of the first frequency band (2400 MHz to 2500 MHz), the second frequency band (5150 MHz to 5850 MHz), the third frequency band (6125 MHz to 7125 MHz) and the fourth frequency band (1500 MHz to 1650 MHz).

Figure 11:
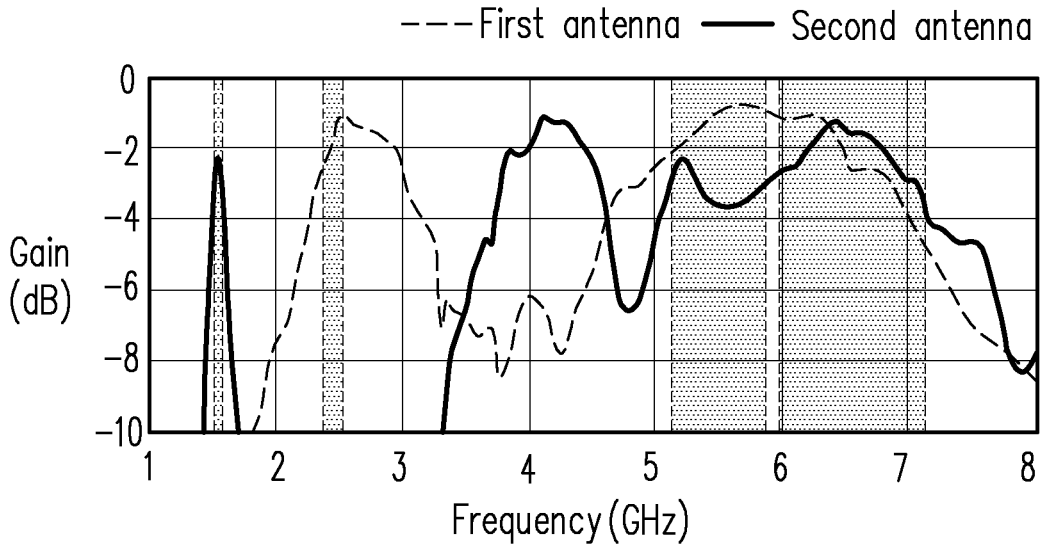
FIG. 11 is a gain versus frequency graph for the first antenna and the second antenna of the antenna module of FIG. 1.

FIG. 11 is a gain versus frequency graph for the first antenna and the second antenna of the antenna module of FIG. 1. Referring to FIG. 11, the first antenna 110 and the second antenna 120 can provide good performance with an antenna gain greater than −4 dB in all of the first frequency band (2400 MHz to 2500 MHz), the second frequency band (5150 MHz to 5850 MHz), the third frequency band (6125 MHz to 7125 MHz) and the fourth frequency band (1500 MHz to 1650 MHz).

In addition, through simulation, for the first antenna 110, an average antenna efficiency at 2.4 GHz can reach 66.34%, −1.78 dB; an antenna efficiency at 5 GHz can reach 75.16%, −1.24 dB; An antenna efficiency at 6 GHz can reach 58.74%, −2.31 dB. For the second antenna 120, an antenna efficiency at 5 GHz can reach 66.34%, −1.78 dB; an antenna efficiency at 6 GHz can reach 61.94%, −2.08 dB. The first antenna 110 and the second antenna 120 with the antenna efficiencies all greater than 45% in the aforementioned frequency bands can provide good antenna radiation characteristics.

In summary, the first antenna of the antenna module of the invention includes the first radiator, the second radiator and the third radiator. The first end of the first antenna is the first feed-in end. The second radiator and the third radiator are connected to the second end of the first radiator. The second radiator has the first ground. The second antenna of the antenna module includes the fourth radiator, the fifth radiator and the sixth radiator. The fifth radiator is connected to the second feed-in end of the fourth radiator. The sixth radiator is connected to the fifth radiator. The second ground is located at the intersection between the fifth radiator and the sixth radiator. Through the above configuration, the antenna module of the invention can meet the requirements of multiple frequency bands.

The invention claimed is:

1. An antenna module, adapted to be disposed on a frame, the antenna module comprising:

a first antenna, comprising a first radiator, a second radiator and a third radiator, wherein the first radiator has a first end and a second end opposite to each other, the first end is a first feed-in end, the second radiator and the third radiator are connected to the second end of the first radiator, the second radiator has a first ground; and a second antenna, comprising a fourth radiator, a fifth radiator and a sixth radiator, wherein the fourth radiator has a second feed-in end, the fifth radiator is connected to the second feed-in end, the sixth radiator is connected to the fifth radiator, a second ground is located at an intersection between the fifth radiator and the sixth radiator;

wherein the antenna module covers a first frequency band, a second frequency band and a third frequency band.

2. The antenna module of claim 1, wherein a width of the third radiator is 0.4 times to 0.6 times a width of the first radiator.

3. The antenna module of claim 1, wherein the frame comprises a top surface, a first lateral surface, a bottom surface, and a first inclined surface located below the top surface and connected to the bottom surface, which are connected to each other, the first radiator is bended into multiple sections and has a conductive hole to be adapted to pass through the frame from the bottom surface along the first inclined surface to the top surface and extend to the first lateral surface, the first feed-in end is located on the bottom surface, the second radiator is disposed on the bottom surface, and the third radiator is disposed on the first lateral surface.

4. The antenna module of claim 3, wherein the first antenna further comprises a first extension, adapted to be disposed on the top surface and connected to a portion of the first radiator located on the top surface.

5. The antenna module of claim 1, wherein the frame comprises a top surface, a second inclined surface, a second lateral surface, a bottom surface, and a third inclined surface, and an inner surface, which are connected to each other, the fourth radiator is bent into multiple sections to be adapted to extend from the bottom surface, the second lateral surface, and the top surface to the second inclined surface, the fifth radiator is adapted to extend from the bottom surface and the third inclined surface to the inner surface, and the sixth radiator is adapted to be at least disposed on the bottom surface.

6. The antenna module of claim 5, wherein a width of a portion of the fourth radiator located on the top surface is greater than a width of a remaining portion of the fourth radiator.

7. The antenna module of claim 5, wherein the second antenna further comprises a second extension extending from the second feed-in end and parallel to a portion of the fifth radiator, the second extension is adapted to be disposed on the third inclined surface and the inner surface, and the second extension comprises a second conductive hole to be adapted to pass through the frame.

8. The antenna module of claim 5, wherein the frame comprises a fourth inclined surface located between the top surface and the inner surface, the second antenna further comprises a third extension, the third extension comprises a third conductive hole to be adapted to pass through the frame to be connected to the fifth radiator, and the third extension is adapted to be disposed on the fourth inclined surface and located beside the fourth radiator.

9. The antenna module of claim 8, wherein a width of the third extension is less than a width of the fifth radiator.

10. The antenna module of claim 1, wherein the first frequency band is commonly coupled by the first radiator and the second radiator, the second frequency band is commonly coupled by the second radiator and the third radiator, the third frequency band is coupled by the second radiator, the second frequency band is coupled by the fifth radiator, and the third frequency band is commonly coupled by a part of the fifth radiator and the sixth radiator.

11. The antenna module of claim 10, wherein the first frequency band is between 2400 MHz and 2500 MHz, the second frequency band is between 5150 MHz and 5850 MHz, and the third frequency band is between 6125 MHz and 7125 MHz.

12. The antenna module of claim 1, wherein a fourth frequency band is coupled by the fourth radiator, and the fourth frequency band is between 1500 MHz and 1650 MHz.

13. An electronic device, comprising:

a frame; and an antenna module, disposed on a plurality of surfaces of the frame, and comprising:

a first antenna, comprising a first radiator, a second radiator and a third radiator, wherein the first radiator has a first end and a second end opposite to each other, the first end is a first feed-in end, the second radiator and the third radiator are connected to the second end of the first radiator, the second radiator has a first ground; and a second antenna, comprising a fourth radiator, a fifth radiator and a sixth radiator, wherein the fourth radiator has a second feed-in end, the fifth radiator is connected to the second feed-in end, the sixth radiator is connected to the fifth radiator, a second ground is located at an intersection between the fifth radiator and the sixth radiator;

wherein the antenna module covers a first frequency band, a second frequency band and a third frequency band.

14. The electronic device of claim 13, wherein a width of the third radiator is 0.4 times to 0.6 times a width of the first radiator.

15. The electronic device of claim 13, wherein the surfaces of the frame comprise a top surface, a first lateral surface, a bottom surface, and a first inclined surface located below the top surface and connected to the bottom surface, which are connected to each other, the first radiator is bended into multiple sections and has a conductive hole to pass through the top surface from the bottom surface along the first inclined surface and extend to the first lateral surface, the first feed-in end is located on the bottom surface, the second radiator is disposed on the bottom surface, and the third radiator is disposed on the first lateral surface, wherein the first antenna further comprises a first extension, disposed on the top surface and connected to a portion of the first radiator located on the top surface.

16. The electronic device of claim 13, wherein the surfaces of the frame comprise a top surface, a second inclined surface, a second lateral surface, a bottom surface, a third inclined surface, and an inner surface, which are connected to each other, the fourth radiator is bent into multiple sections to extend from the bottom surface, the second lateral surface, and the second inclined surface to the top surface, the fifth radiator extends from the bottom surface and the third inclined surface to the inner surface, and the sixth radiator is at least disposed on the bottom surface.

17. The electronic device of claim 16, wherein a width of a portion of the fourth radiator located on the top surface is greater than a width of a remaining portion of the fourth radiator.

18. The electronic device of claim 16, wherein the second antenna further comprises a second extension extending from the second feed-in end and parallel to a portion of the fifth radiator, the second extension is disposed on the third inclined surface and the inner surface, and the second extension comprises a second conductive hole to pass through the frame.

19. The electronic device of claim 16, wherein the frame comprises a fourth inclined surface located between the top surface and the inner surface, the second antenna further comprises a third extension, the third extension comprises a third conductive hole to pass through the frame to be connected to the fifth radiator, and the third extension is disposed on the fourth inclined surface and parallel a partial edge of the fourth radiator, wherein a width of the third extension is less than a width of the fifth radiator.

20. The electronic device of claim 13, wherein the first frequency band is commonly coupled by the first radiator and the second radiator, the second frequency band is commonly coupled by the second radiator and the third radiator, the third frequency band is coupled by the second radiator, the second frequency band is coupled by the fifth radiator, and the third frequency band is commonly coupled by a part of the fifth radiator and the sixth radiator, wherein the first frequency band is between 2400 MHz and 2500 MHz, the second frequency band is between 5150 MHz and 5850 MHz, and the third frequency band is between 6125 MHz and 7125 MHz.

21. The electronic device of claim 13, wherein a fourth frequency band is coupled by the fourth radiator, and the fourth frequency band is between 1500 MHz and 1650 MHz.

* * * * *